US008313358B2

(12) United States Patent
Barnat

(10) Patent No.: US 8,313,358 B2
(45) Date of Patent: Nov. 20, 2012

(54) NOTCHED GRIND WHEEL AND METHOD TO MANUFACTURE A ROTOR BLADE RETENTION SLOT

(75) Inventor: Krzysztof Barnat, Berlin, CT (US)

(73) Assignee: United Technologies Corporation, Hartford, CT (US)

( * ) Notice: Subject to any disclaimer, the term of this patent is extended or adjusted under 35 U.S.C. 154(b) by 210 days.

(21) Appl. No.: 12/870,903

(22) Filed: Aug. 30, 2010

(65) Prior Publication Data

US 2010/0323596 A1 Dec. 23, 2010

Related U.S. Application Data

(63) Continuation of application No. 12/207,912, filed on Sep. 10, 2008, now Pat. No. 7,846,010.

(51) Int. Cl.
*B24B 51/00* (2006.01)
*B24D 5/00* (2006.01)

(52) U.S. Cl. ..... 451/11; 451/542; 125/15

(58) Field of Classification Search ..... 451/5, 11, 451/21, 541, 542, 543, 58, 61; 125/15
See application file for complete search history.

(56) References Cited

U.S. PATENT DOCUMENTS

| | | | | |
|---|---|---|---|---|
| 1,614,558 | A | 1/1927 | Kasley | |
| 3,146,561 | A | 9/1964 | Lindblad | |
| 3,221,728 | A * | 12/1965 | Lindblad | 125/15 |
| 3,590,535 | A * | 7/1971 | Benson et al. | 451/542 |
| 3,599,622 | A * | 8/1971 | Baron | 125/15 |
| 3,711,999 | A * | 1/1973 | Held | 451/541 |
| 4,267,814 | A | 5/1981 | Benson et al. | |
| 4,439,951 | A | 4/1984 | Oppelt et al. | |
| 4,505,075 | A | 3/1985 | Salmon et al. | |
| 4,512,115 | A | 4/1985 | Miller | |
| 4,537,538 | A | 8/1985 | Mitamura et al. | |
| 4,566,225 | A | 1/1986 | Bizot et al. | |
| 4,665,887 | A * | 5/1987 | Shiga | 125/15 |
| 4,705,017 | A | 11/1987 | Lewis | |
| 4,924,637 | A | 5/1990 | Ikimi et al. | |
| 5,152,669 | A | 10/1992 | Heinig et al. | |
| 5,176,480 | A | 1/1993 | Kelm | |
| 5,330,326 | A | 7/1994 | Kuehne et al. | |
| 5,430,936 | A | 7/1995 | Yazkzik, Jr. et al. | |
| 5,465,706 | A * | 11/1995 | Sawluk | 125/15 |
| 5,567,116 | A | 10/1996 | Bourcier | |
| 5,697,359 | A * | 12/1997 | Okanishi et al. | 125/15 |
| 5,931,616 | A | 8/1999 | Daub | |
| 6,302,651 | B1 | 10/2001 | Kildea et al. | |
| 6,322,296 | B1 | 11/2001 | Wetli et al. | |
| 6,568,383 | B2 * | 5/2003 | Spangenberg | 125/15 |
| 6,883,234 | B2 | 4/2005 | Packman et al. | |
| 7,007,382 | B2 | 3/2006 | Mantel | |
| 2009/0214351 | A1 | 8/2009 | Guo | |

FOREIGN PATENT DOCUMENTS

| | | |
|---|---|---|
| DE | 3006645 A1 | 9/1981 |
| DE | 4114409 | 10/1992 |
| DE | 4120640 | 12/1992 |
| EP | 0550765 | 7/1993 |
| GB | 2382317 | 5/2003 |
| JP | 58202709 | 11/1983 |
| JP | 58217233 | 12/1983 |
| JP | 6270006 | 9/1994 |
| JP | 2000326133 | 11/2000 |

* cited by examiner

*Primary Examiner* — Robert Rose
(74) *Attorney, Agent, or Firm* — Carlson, Gaskey & Olds PC

(57) ABSTRACT

A grind wheel includes a rim having at least one notch formed in the rim to grind a slot base of a blade retention slot within a rotor disk.

6 Claims, 10 Drawing Sheets

NOTCHED GRIND WHEEL AND METHOD TO MANUFACTURE A ROTOR BLADE RETENTION SLOT

REFERENCE TO RELATED APPLICATIONS

The present disclosure is a continuation of U.S. patent application Ser. No. 12/207,912, filed Sep. 10, 2008 now U.S. Pat. No. 7,846,010.

BACKGROUND

The present disclosure relates to process tooling and procedures to grind blade retention slots within a rotor disk of a gas turbine engine.

In gas turbine engines, a multiple of fan, compressor, and turbine section rotor blades are secured to respective disks. One attachment arrangement utilizes rotor blade roots that are complementary received within respective blade retention slots formed in a rotor disk periphery.

One exemplary configuration of a blade retention slot includes a convoluted profile with a multiple of lobes that generally increases in a transverse dimension from the blade retention slot base toward the disk periphery. These configurations are often referred to as a fir-tree slot. Although an effective operational configuration, the slot base is typically wider than the narrowest lobe such that the slot base may be a relatively difficult area to grind.

SUMMARY

An exemplary grind wheel according to an exemplary aspect includes a rim having at least one notch formed in the rim.

An exemplary method of grinding a slot base of a blade retention slot within a rotor disk according to an exemplary aspect includes rotationally aligning a grind wheel about an axis of rotation to align a notch with a first and second opposed lobe of a blade retention slot of a rotor disk. Transiting the grind wheel along the blade retention slot such that the notch is passed between a lobe width defined by the first and second opposed lobe of the blade retention slot. Transiting the rotating grind wheel along the blade retention slot to grind a slot base of the blade retention slot with a rim of the grind disk.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1:
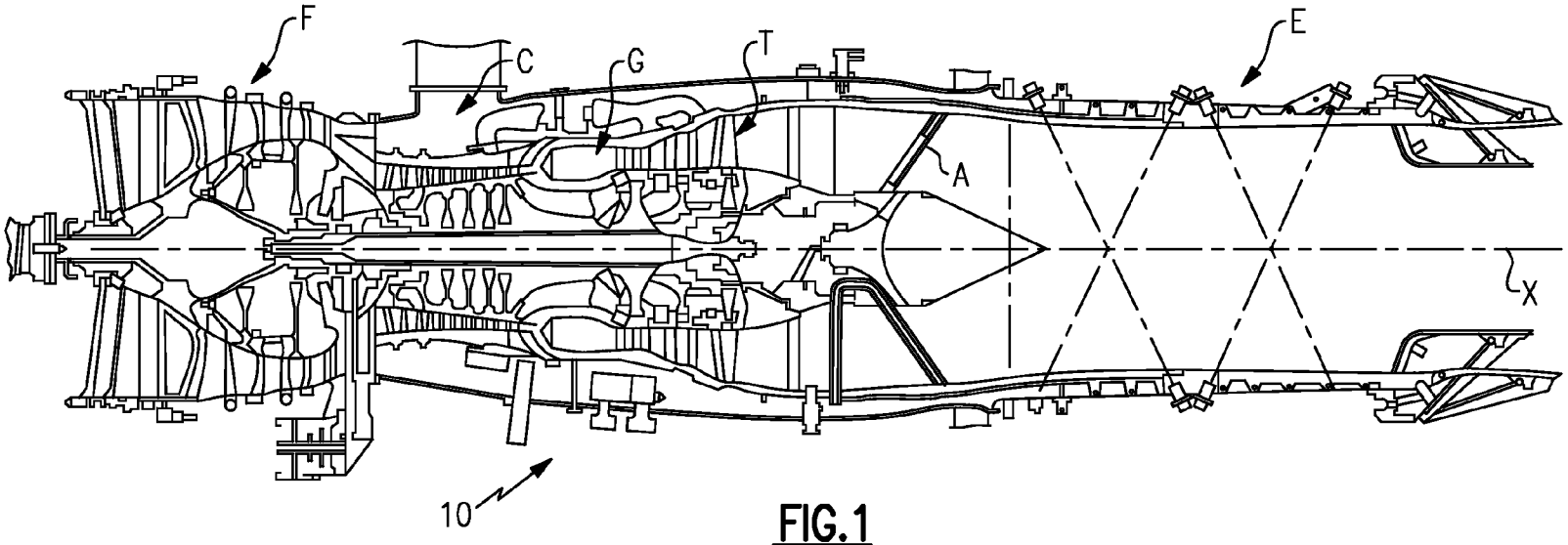
FIG. 1 is a schematic illustration of a gas turbine engine.

FIG. 1 schematically illustrates a gas turbine engine 10 which generally includes a fan section F, a compressor section C, a combustor section G, a turbine section T, an augmentor section A, and an exhaust duct assembly E. The compressor section C, combustor section G, and turbine section T are generally referred to as the core engine. An engine longitudinal axis X is centrally disposed and extends longitudinally through these sections. Although a particular engine configuration is illustrated and described in the disclosed embodiment, other engines will also benefit herefrom.

Figure 2A:
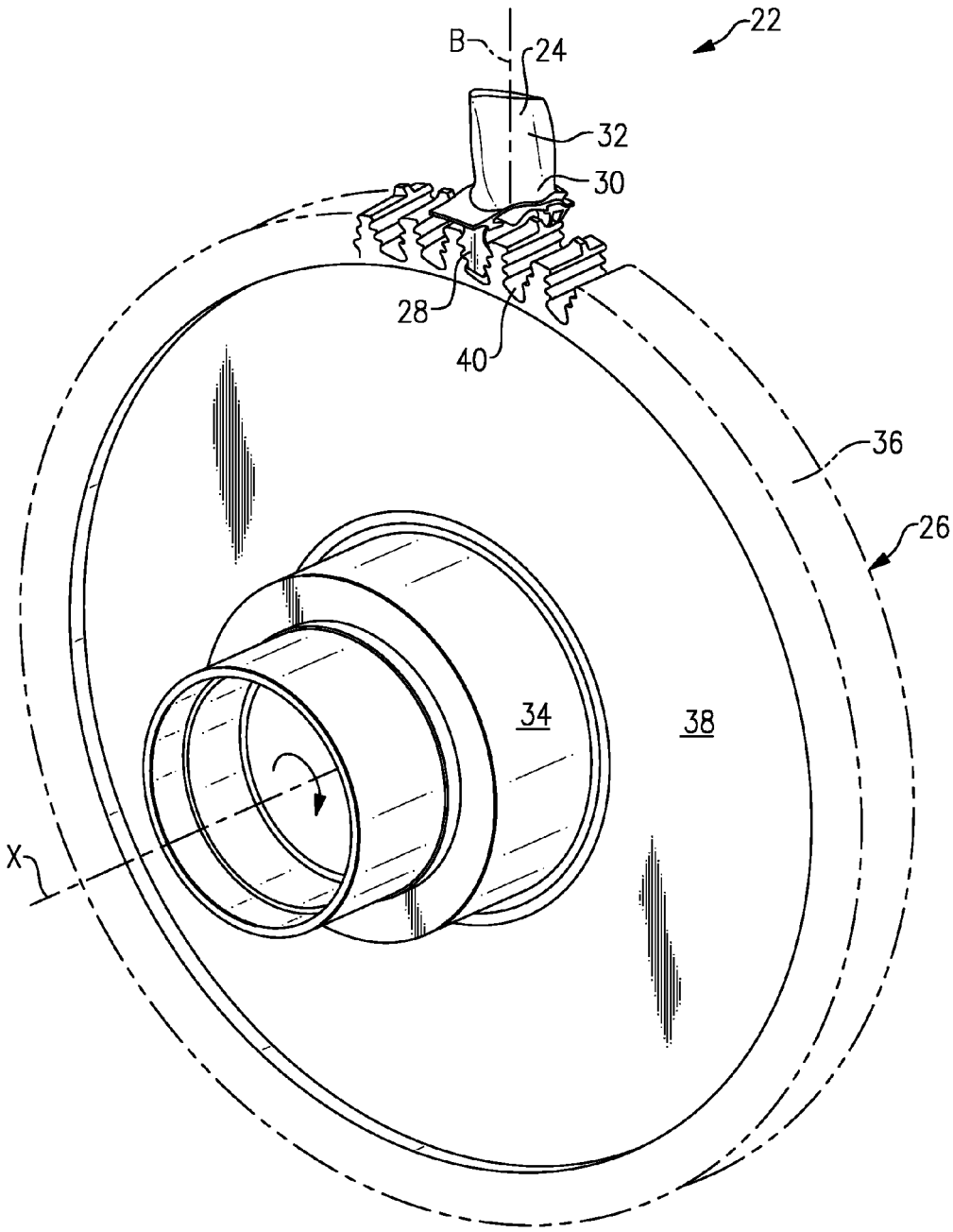
FIG. 2A is an expanded perspective view of a single rotor blade mounted to a rotor disk.

Referring to FIG. 2A, a rotor assembly 22 of the gas turbine engine 10 is illustrated. It should be understood that a multiple of rotor disks may be contained within each engine section such as the fan section, the compressor section and, the turbine section. Although a particular rotor assembly 22 is illustrated and described in the disclosed embodiment, other sections which have other blades such as fan blades, low pressure turbine blades, high pressure turbine blades, high pressure compressor blades and low pressure compressor blades will also benefit herefrom.

Figure 2B:
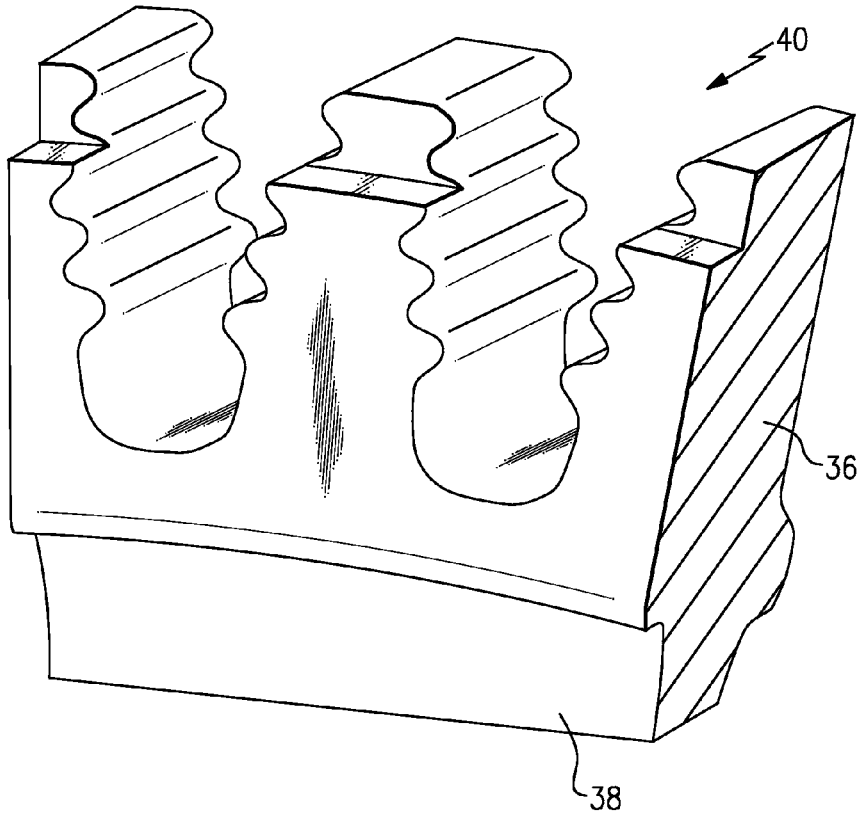
FIG. 2B is an expanded view of a blade retention slot of the rotor disk of FIG. 2.

The rotor assembly 22 includes a plurality of blades 24 (one shown) circumferentially disposed around a rotor disk 26. Each blade 24 generally includes an attachment section 28, a platform section 30, and an airfoil section 32 along a radial axis B. The rotor disk 26 generally includes a hub 34, a rim 36, and a web 38 which extends therebetween. Each of the blades 24 is received within a blade retention slot 40 formed within the rim 36 of the rotor disk 26 (also illustrated in FIG. 2B). The blade retention slot 40 includes a contour such as a fir-tree or bulb type which corresponds with a contour of the attachment section 28 to provide engagement therewith.

Figure 2C:
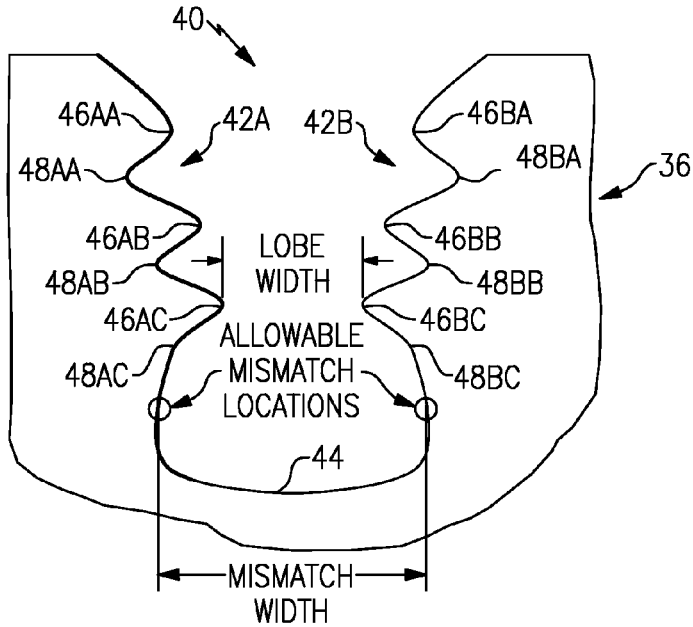
FIG. 2C is a front view of a blade retention slot of the rotor disk of FIG. 2.

Referring to FIG. 2C, the blade retention slot 40 is generally defined by a first convoluted side 42A, a second convoluted side 42B and a slot base 44 therebetween. The first convoluted side 42A includes a multiple of lobes 46AA, 46AB and 46AC with a multiple of pockets 48AA, 48AB and 48AC. The second convoluted side 42B likewise includes a multiple of lobes 46BA, 46BB, 46BC and a multiple of pockets 48BA, 48BB and 48BC. It should be understood that the blade retention slot 40 may be machined through various methodologies. Although a fir-tree type convoluted contour with a particular number of lobes and pockets are illustrated in the disclosed embodiment, it should be understood that any convoluted shape with any number of lobes and pockets may benefit herefrom.

The distance between the most radial inward lobes 46AC, 46BC define a lobe width which is less than a width of the slot base 44. That is, a mismatch width which at least partially defines the slot base 44 is wider than the lobe width between lobes 46AC, 46BC. This has heretofore complicated grinding the slot base 44.

Figure 3B:
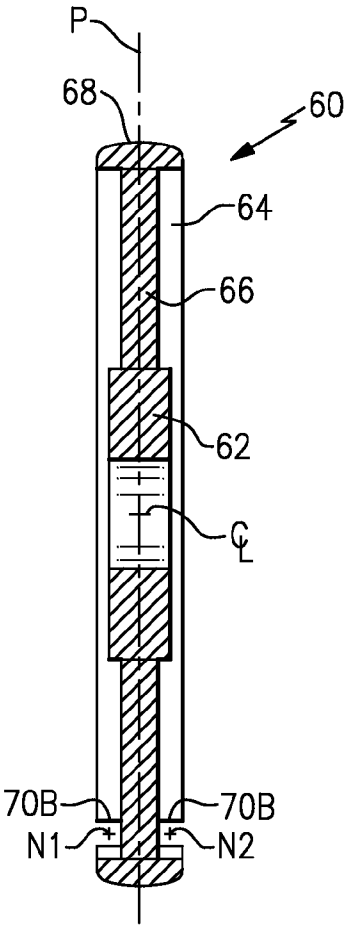
FIG. 3B is a cross-sectional view of the grind wheel taken along line 3B-3B in FIG. 3A.
Figure 3A:
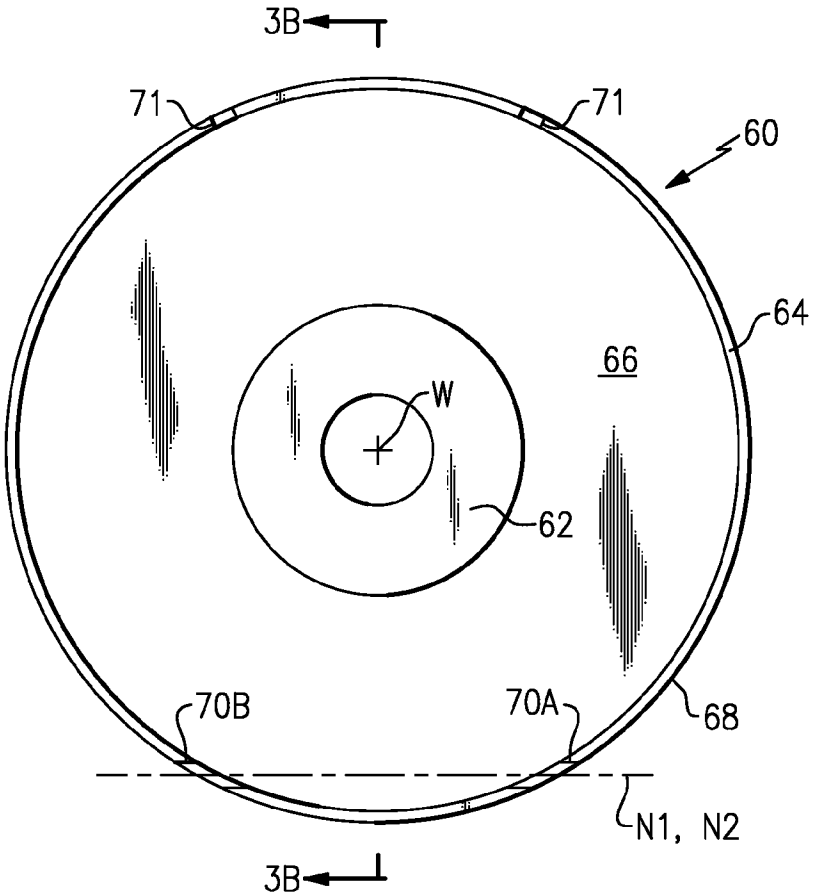
FIG. 3A is a side view of one non-limiting embodiment of a grind wheel to grind a slot base of a blade retention slot of a rotor disk.

Referring to FIG. 3A, a grind wheel 60 generally includes a hub 62 defined about an axis of rotation W, a rim 64 and a web 66 between the hub 62 and the rim 64. The rim 64 is defined about the web 66 and includes a grinding surface 68 and shape (also illustrated in FIG. 3B) to grind the slot base 44 to a desired contour. The rim 64 is of a greater width than the web 66 (FIG. 3B) and generally defines the mismatch width.

A notch axis N1, N2 is defined transverse to the axis of rotation W. That is each notch axis N1, N2 may be considered a secant line relative the rim 64. Each notch axis N1, N2 is defined within a plane generally parallel to the web 66 (FIG. 3B) but through the rim 64. Each notch axis N1, N2 is also outside of a plane P perpendicular to the axis of rotation W that passes through the web 66. That is, each notch axis N1, N2 does not intersect the plane P which is defined along the centerline of the grind wheel 60 (FIG. 3B). A first notch 70A and a second notch 70B are defined through the rim 64 along the respective notch axis N1, N2 at a distance from the grinding surface 68 such that the lobes 46AC, 46BC will pass through the notches 70A, 70B when the grind wheel 60 is in a predefined rotationally fixed position. The first notch 70A and the second notch 70B are located on opposing side faces of the web 66.

Notably, the first notch 70A and the second notch 70B may be formed in a generally standard size grind wheel such as that manufactured by Saint-Gobain Abrasives of Worcester, Mass. USA to provide significantly more grit area to grind the slot base 44 which facilitates a more consistent surface over the mismatch width. The mismatch width is generally defined by allowable mismatch locations at which one tool such as the grind wheel 60 intersects a surface formed by a different tool such as a cutting tool. The mismatch width is readily satisfied with, for example only, but one pass of the grind wheel 60. It should be further understood that additional notches such as balance notches 71 (FIG. 3A) may additionally be located on the grind wheel 60 to facilitate balanced operation thereof.

Figure 4:
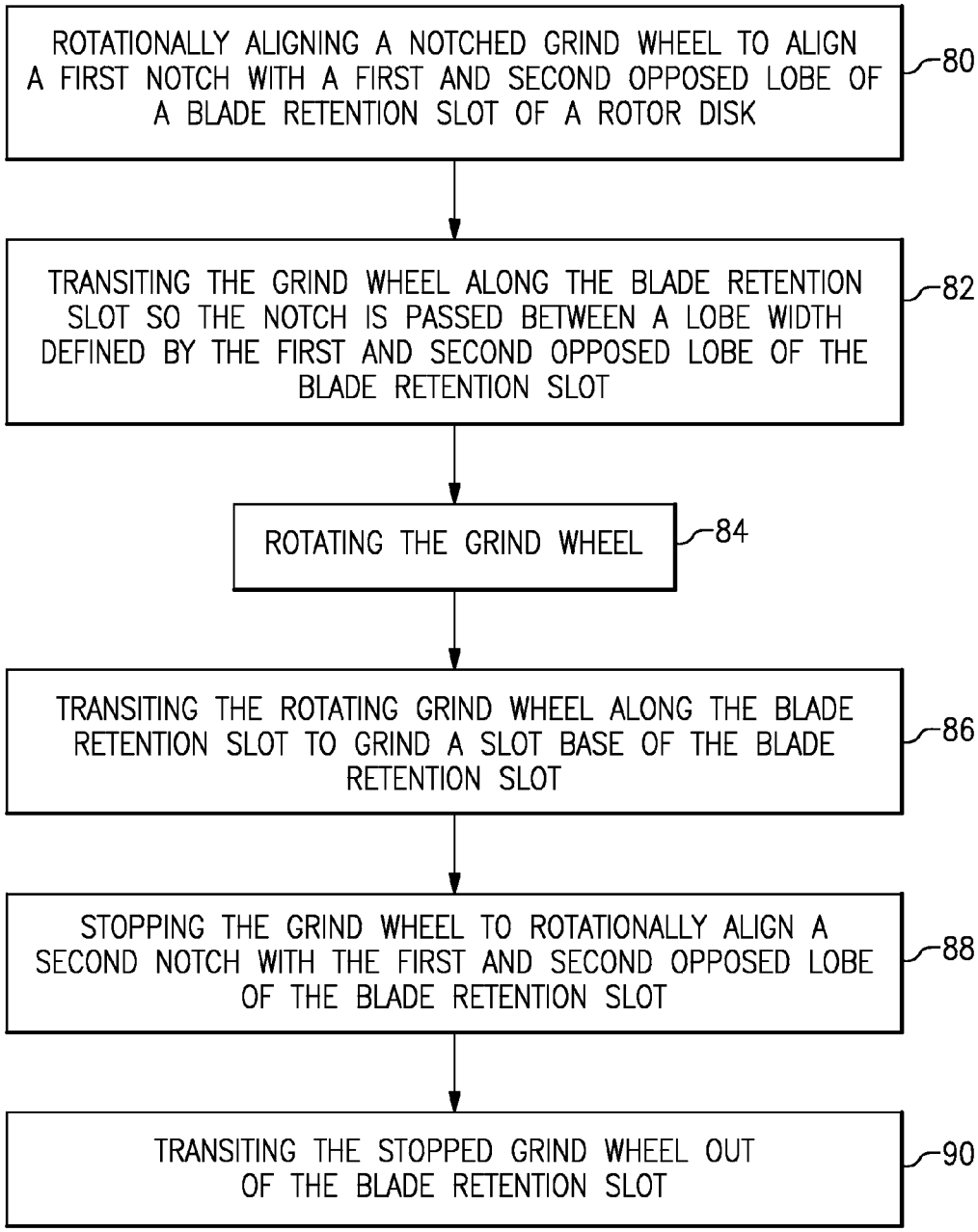
FIG. 4 is a flowchart which illustrates one non-limiting embodiment of a method to grind a slot base of a blade retention slot of a rotor disk.
Figure 5A:
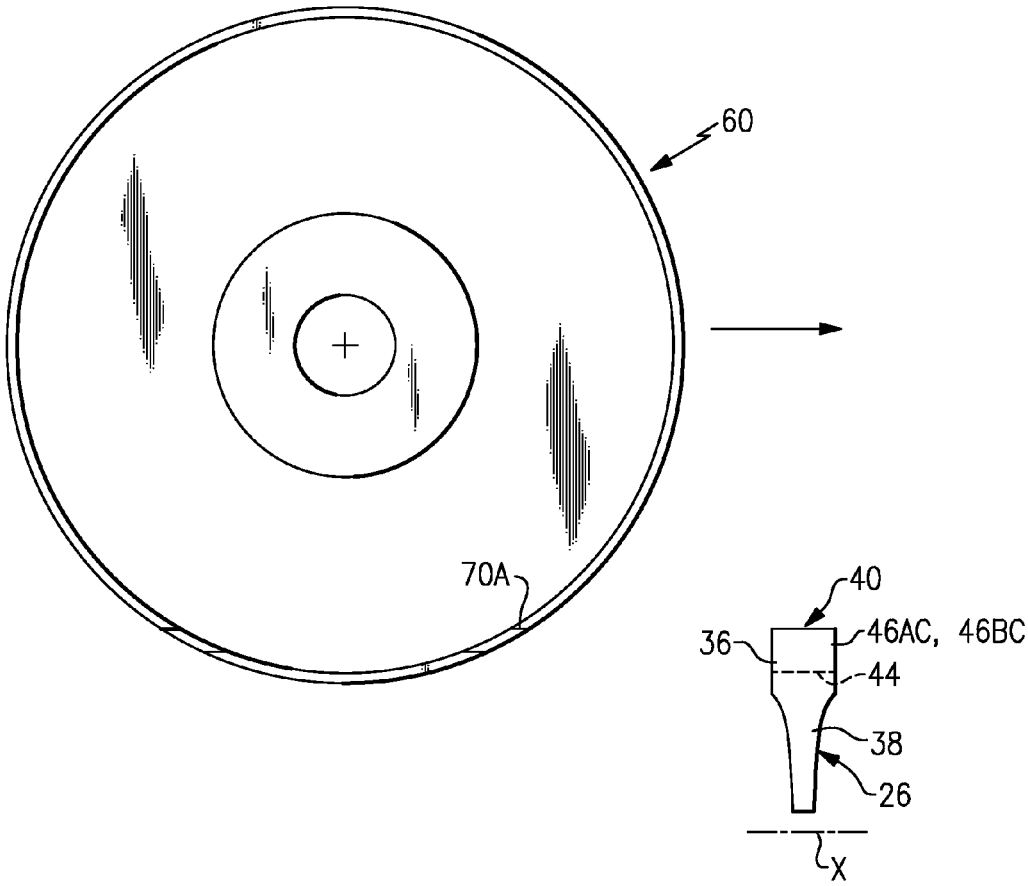
FIG. 5A is a schematic view of a grind wheel rotationally aligned with a first and second opposed lobe of a blade retention slot.
Figure 5B:
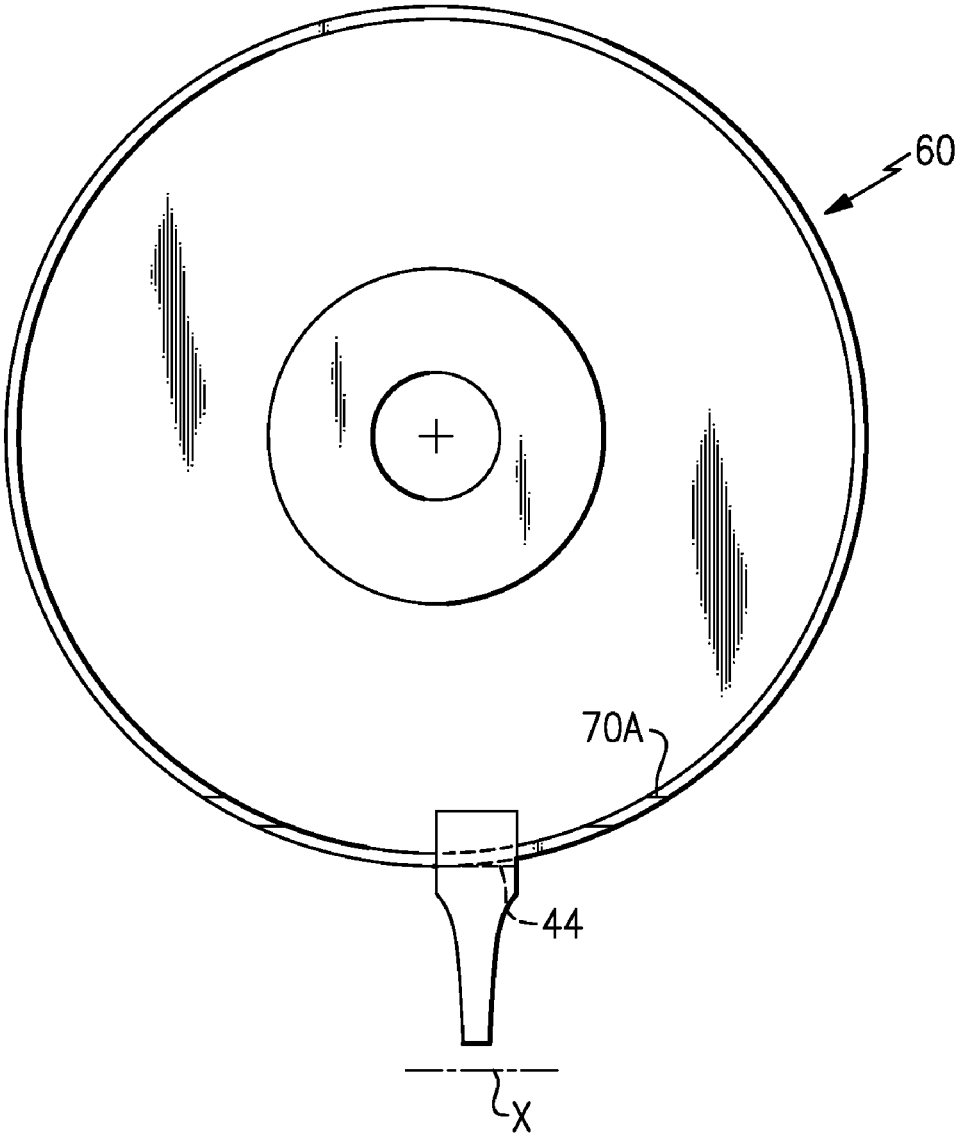
FIG. 5B is a schematic view of the grind wheel transiting into the blade retention slot.
Figure 5C:
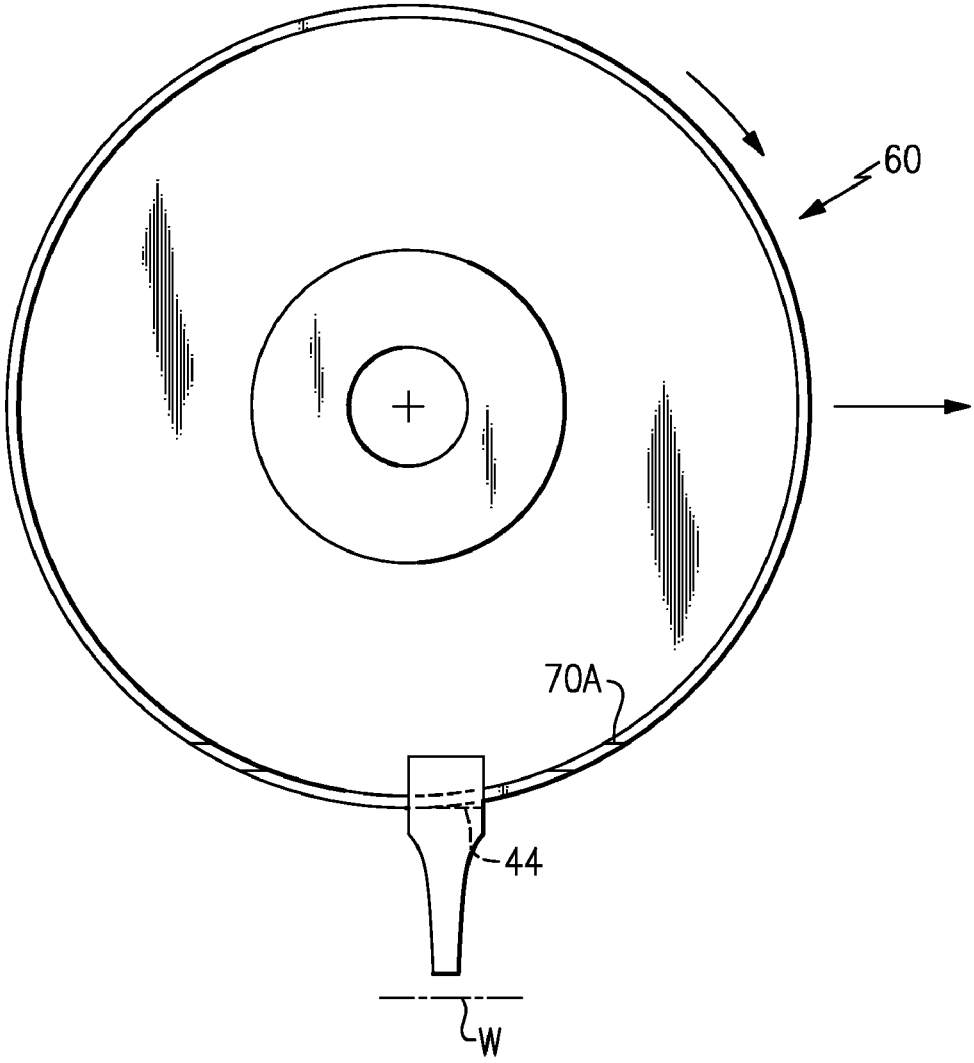
FIG. 5C is a schematic view of the grind wheel grinding the slot base of the blade retention slot.
Figure 5D:
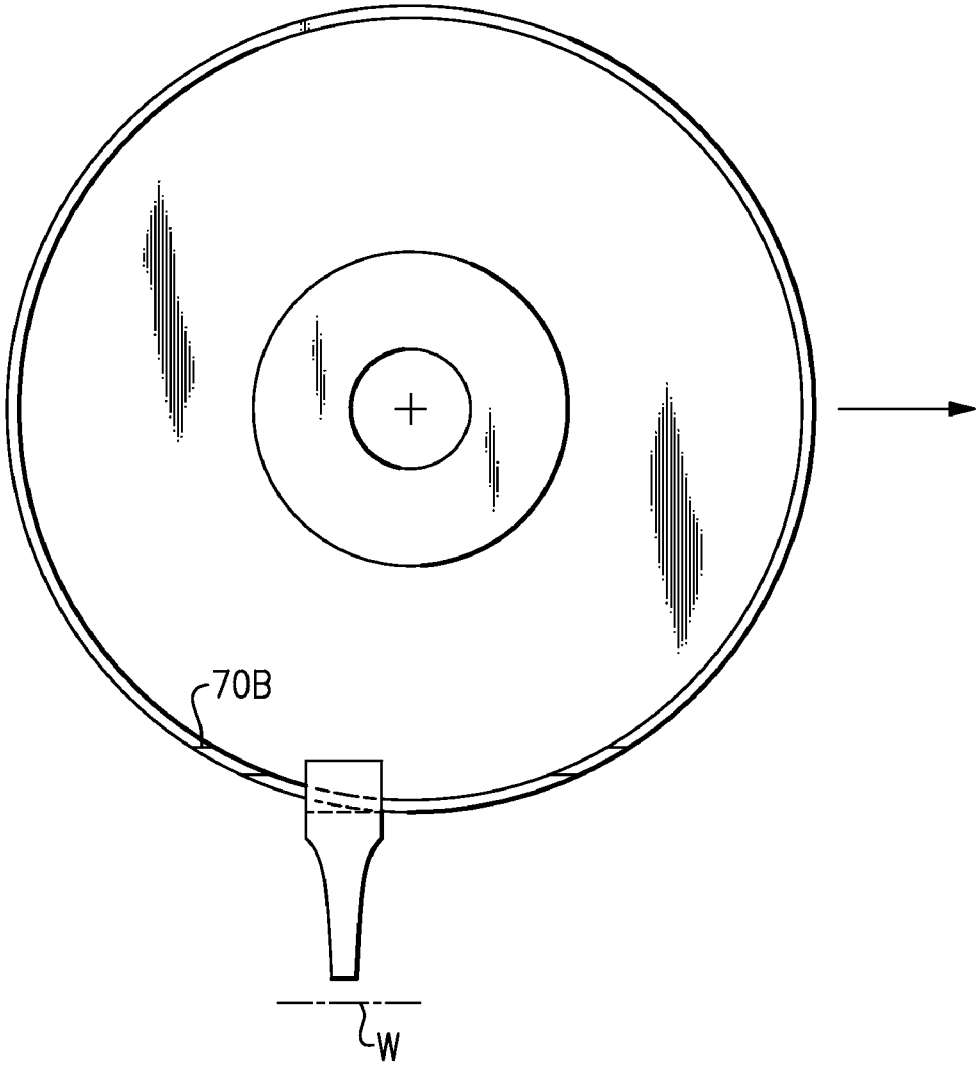
FIG. 5D is a schematic view of the grind wheel rotationally aligned with a first and second opposed lobe of a blade retention slot.
Figure 5E:
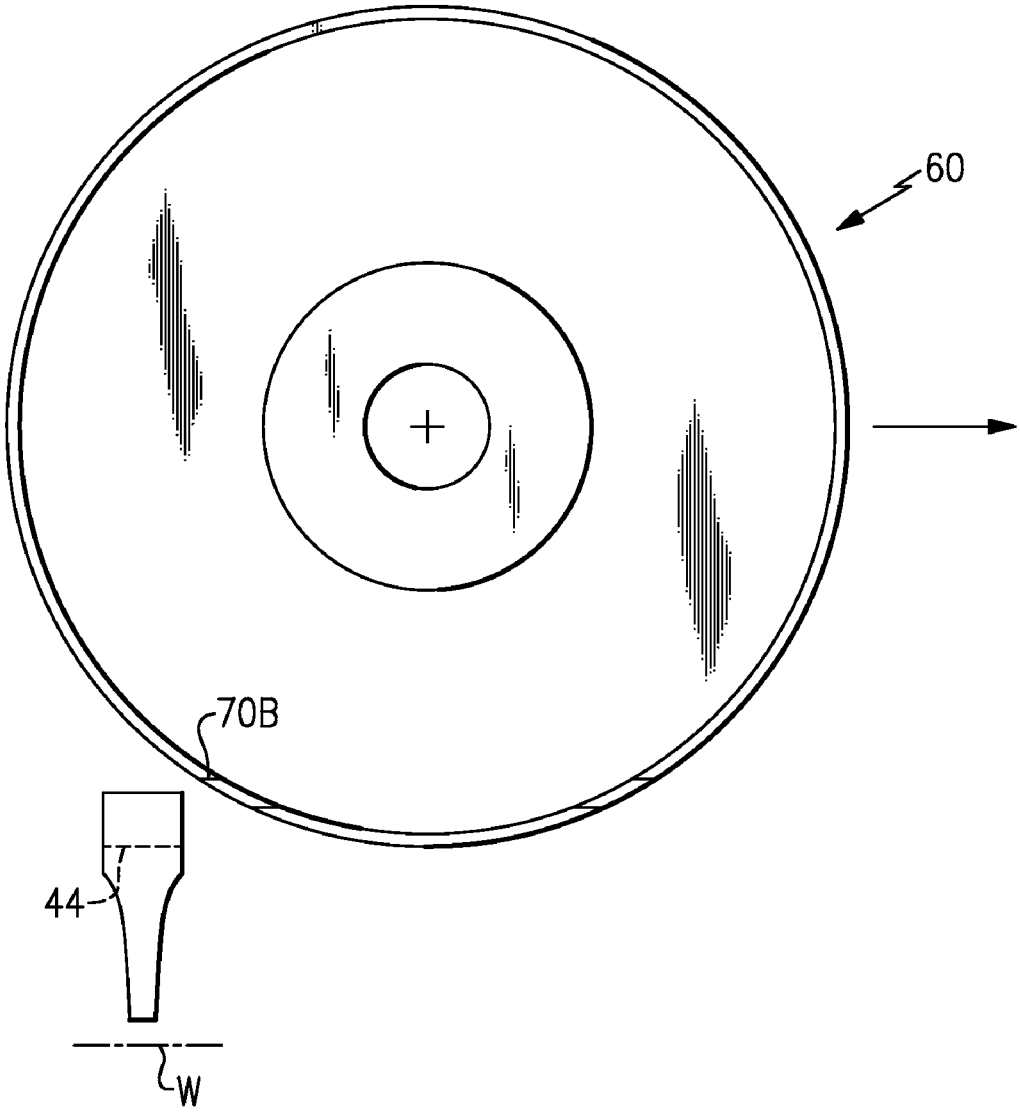
FIG. 5E is a schematic view of the grind wheel stopped and transiting out of the blade retention slot.

Referring to FIG. 4, the following methodology of one non-limiting embodiment may be utilized to grind the slot base 44 to a desired contour. In step 80, the grind wheel 60 is first rotationally fixed to align the first notch 70A with the lobes 46AC, 46BC (FIG. 5A) such that the first notch 70A is then passed between the lobes 46AC, 46BC in step 82 (FIG. 5B). Next, in step 84, the grind wheel 60 is rotated about axis W at operational speed. In step 86, the slot base 44 is ground as the grind wheel 60 is transited along the blade retention slot 40. The web 66 is of a lesser width than the narrowest lobe width between lobes 46AC, 46BC such that the grind wheel 60 may be transited along the blade retention slot 40 so that the relatively wider grinding surface 68 will readily grind the slot base 44 (FIG. 5C). Once the slot base 44 is ground, the grind wheel 60 is rotationally fixed to align the notch 70B with the lobes 46AC, 46BC in step 88 (FIG. 5D) such that the notch 70B is passed between the lobes 46AC, 46BC (FIG. 5E) to remove the grind wheel 60 from the blade retention slot 40 in step 90 (FIG. 5E). This process may be repeated to grind each of the multiple of blade retention slots 40.

It should be understood that although a particular component arrangement is disclosed in the illustrated embodiment, other arrangements may also benefit from the disclosed exemplary embodiments.

Although particular step sequences are shown, described, and claimed, it should be understood that steps may be performed in any order, separated or combined unless otherwise indicated.

The foregoing description is exemplary rather than defined by the limitations within. Many modifications and variations are possible in light of the above teachings. Non-limiting embodiments are disclosed herein, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A grind wheel comprising:

a hub defined about an axis of rotation;

a web defined about said hub which defines a web thickness; and a rim defined about said web, said rim having a rim thickness greater than said web thickness, wherein said rim includes first and second notches proximate one another on the same side of said hub, said first and second notches provided through said rim but not through said web;

wherein said first notch is provided on one side of said web to define a first notch axis along a first secant line with respect to said rim, and said second notch is provided on an opposite side of said web to define a second notch axis along a second secant line with respect to said rim; and wherein said first and second secant lines are substantially parallel to one another, said first and second secant lines offset from said axis of rotation.

2. The grind wheel as recited in claim 1, wherein said first and second secant lines are outside of a plane perpendicular to said axis of rotation that passes through said web.

3. The grind wheel as recited in claim 1, wherein said first and second secant lines do not intersect a plane perpendicular to said axis of rotation that passes through said web.

4. The grind wheel as recited in claim 1, wherein said notches are reflections of one another across a plane perpendicular to said axis of rotation that passes through said web.

5. The grind wheel as recited in claim 1, wherein neither of the first or second secant lines passes through said axis of rotation.

6. The grind wheel as recited in claim 1, further including third and fourth notches provided in said rim on an opposite side of said hub from said first and second notches, said third notch provided along said first secant line, and said fourth notch provided along said second secant line.

* * * * *